United States Patent [19]

Seitz

[11] 4,333,387

[45] Jun. 8, 1982

[54] ANTI-JAM HYDRAULIC SERVO VALVE

[75] Inventor: Clyde R. Seitz, Laguna Beach, Calif.

[73] Assignee: Bertea Corporation, Irvine, Calif.

[21] Appl. No.: 127,735

[22] Filed: Mar. 6, 1980

Related U.S. Application Data

[63] Continuation of Ser. No. 888,700, Mar. 21, 1978, abandoned.

[51] Int. Cl.[3] ..... F01B 25/26

[52] U.S. Cl. ..... 91/1; 91/448; 137/557; 137/596; 137/625.68

[58] Field of Search ..... 91/1, 384, 444, 448, 91/509, 510, 430; 137/625.69, 557, 625.68

[56] References Cited

U.S. PATENT DOCUMENTS

| | | | |
|---|---|---|---|
| 2,613,650 | 10/1952 | Mott | 91/20 |
| 3,253,613 | 5/1966 | Richolt | 137/596 |
| 3,439,707 | 4/1969 | York | 137/596 |
| 3,482,486 | 12/1969 | Nordholm, Jr. | 91/1 |
| 3,529,514 | 9/1970 | Mayo | 91/509 |
| 3,561,322 | 2/1971 | Gerstine | 91/1 |
| 3,933,176 | 1/1976 | Wheeler | 91/510 |
| 4,112,824 | 9/1978 | Krause | 91/448 |

*Primary Examiner*—Abraham Hershkovitz
*Attorney, Agent, or Firm*—Gordon L. Peterson

[57] ABSTRACT

A servo valve for controlling an actuator comprising a housing, a first slide movable in the housing for controlling the flow of fluid to and from the actuator and a second slide mounted for movement in the housing. Both of the slides are movable in the housing during normal operation of the servo valve. Each of the slides is movable in the housing when the other of the slides jams. A jam sensor responds to either of the slides jamming for providing a corrective function for the servo valve.

22 Claims, 8 Drawing Figures

ANTI-JAM HYDRAULIC SERVO VALVE

BACKGROUND OF THE INVENTION

This application is a continuation of Application Ser. No. 888,700 filed Mar. 21, 1978, now abandoned, and entitled ANTI-JAM HYDRAULIC SERVO VALVE.

Hydraulic control systems are often used to control the position of an aircraft flight control surface. A typical hydraulic control system includes a servo valve for positioning a hydraulic actuator which in turn positions one of the aircraft control surfaces. The servo valve includes a movable slide which controls the flow of fluid to and from the actuator to control the actuator.

If the hydraulic control system malfunctions, the pilot may lose control of the aircraft, and a crash may result. It is very important, therefore, that the hydraulic control system be very reliable.

One failure than can occur in a servo valve is the sticking or jamming of the movable slide. This may be caused, for example, by contaminants on the slide, warpage, thermal expansion or contraction, or numerous other reasons.

In one prior art servo valve, the slide is an inner slide and it is mounted for movement within an outer slide. The outer slide is detented to a neutral position. During normal operation, the inner slide slides within the outer slide to control the actuator. However, if the inner slide jams to the outer slide, subsequent attempts to move the inner slide will break the outer slide out of its detent and, thereafter, the two slides move together as a unit. The outer slide has ports and grooves so that, when it moves with the inner slide as the result of a jam, it can at least partially control the actuator. Servo valves of this type are shown, for example, in Mott U.S. Pat. No. 2,613,650, Richolt U.S. Pat. No. 3,253,613 and York et al U.S. Pat. No. 3,439,707.

These prior art patented devices significantly reduce the risk of a catastrophic failure of the hydraulic control system. Unfortunately, however, these prior art systems are subject to undisclosed jamming. Specifically, each of these prior art servo valves uses a passive outer slide, i.e., a slide which does not move relative to the housing during normal operation of the servo valve. Thus, any jamming or sticking of the outer slide to the housing is not detectable until the inner slide jams to the outer slide, i.e., until an emergency arises. Of course, if the outer slide were jammed to the housing, neither slide could move and a catastrophic failure would result.

SUMMARY OF THE INVENTION

This invention provides a servo valve which utilizes two slides and both of these slides are active elements, i.e., both of the slides are moved during normal operation of the valve. If either slide jams, a suitable corrective function is performed. Because both of the slides are moved during normal operation of the valve, the problem of undisclosed jamming is eliminated.

At least one of the slides must be capable of controlling the flow of fluid to and from an actuator or other controllable device. Although any valve means may be used for this purpose, a slide is usually preferred. The second slide may also be capable of exerting some control of the flow of fluid to and from the actuator. Alternatively, the second slide may be utilized primarily to monitor the movement of the first slide. Because both of the slides move during normal operation of the valve, no detent for normally holding one of these slides in a fixed position within the valve housing is required. The two slides may be concentric inner and outer slides or they may be arranged in side-by-side nonconcentric relationship.

With this invention, the jamming of either of the slides is immediately sensed. Although this can be accomplished in different ways, it is preferred to use an arrangement in which the two slides move in a predetermined phase relationship which is altered when either of the slides jams. A jam sensor senses when the two slides are not moving in the predetermined phase relationship.

Although various predetermined phase relationships can be used, there are certain implementation advantages to driving the two slides out of phase in opposite directions from each other during normal operation of the servo valve. Thus, when the first slide is moved to the right, the second slide is simultaneously moved a corresponding amount to the left. If a jam occurs, the slides no longer move in opposite directions, and this is sensed by the jam sensor.

Although the jam sensor may be of various different forms, it is preferred to use a jam sensor which includes a valve to port fluid under pressure to a suitable device when the jam occurs. In a preferred form, the two slides drive or carry additional surface means for porting fluid under pressure to a predetermined location to provide an indication of the jamming.

The corrective function can include any form of jam indication or remedial action whatsoever. For example, the porting of fluid under pressure by the jam sensor may actuate an alarm which is readily observable by the pilot, and in this event, the corrective function includes such indication. Alternatively, or in addition thereto, the jam sensor may shut off the supply of fluid to the servo valve and/or the actuator controlled thereby so that the associated flight control surface can thereafter be controlled by a secondary or back-up system. In this event, the corrective function includes the disabling of the servo valve.

The slides of the servo valve can be advantageously driven by an input linkage. Of course, the linkage determines the phase relationship of the two slides. The input linkage includes a detent which permits the input linkage to drive one of the slides after the other of the slides has jammed. When the two slides are concentrically mounted, the detent should be in the section of the linkage which drives the outer slide. This permits a single detent to prevent the linkage from freezing regardless of whether the inner slide jams in the outer slide or the outer slide jams to the housing.

The predetermined phase relationship between the slides is also altered in an open linkage situation that may occur, for example, when a link breaks or a pin falls out of the linkage. This can be accomplished, for example, by using springs or other means to bias the slides to a predetermined position in the event that the linkage section driving such slide opens. Accordingly, if the linkage section driving one of the slides opens, that slide is moved by the springs to a predetermined location and the other of the slides continues to be moved by the linkage section which is still operational. This upsets the predetermined phase relationship between the slides to operate the jam sensor.

The invention can best be understood by reference to the following description taken in connection with the accompanying illustrative drawing.

DESCRIPTION OF THE PREFERRED EMBODIMENT

Figures 1, 1A:
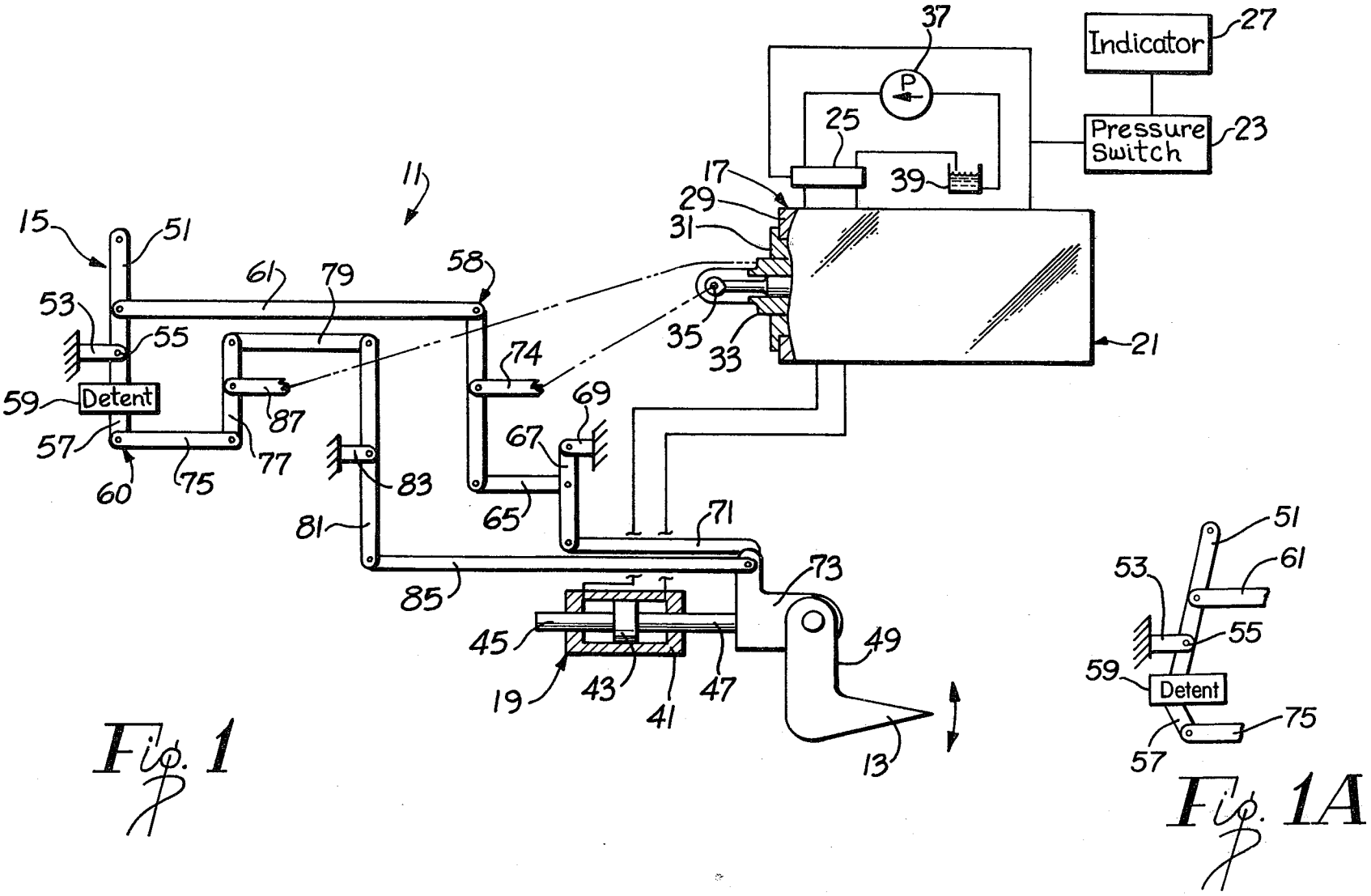
FIG. 1 is a schematic view of a hydraulic control system constructed in accordance with the teachings of this invention.
FIG. 1A is a schematic view of a portion of FIG. 1 illustrating schematically how the detent functions when the outer slide is jammed.

FIG. 1 shows a control system 11 for positioning a flight control surface 13 of an airplane. Generally, the control system 11 includes an input linkage 15, a servo valve 17, an actuator 19, and a jam sensor 21. The system 11 also includes a pressure switch 23, a shut-off valve 25 and an indicator 27.

Figure 2:
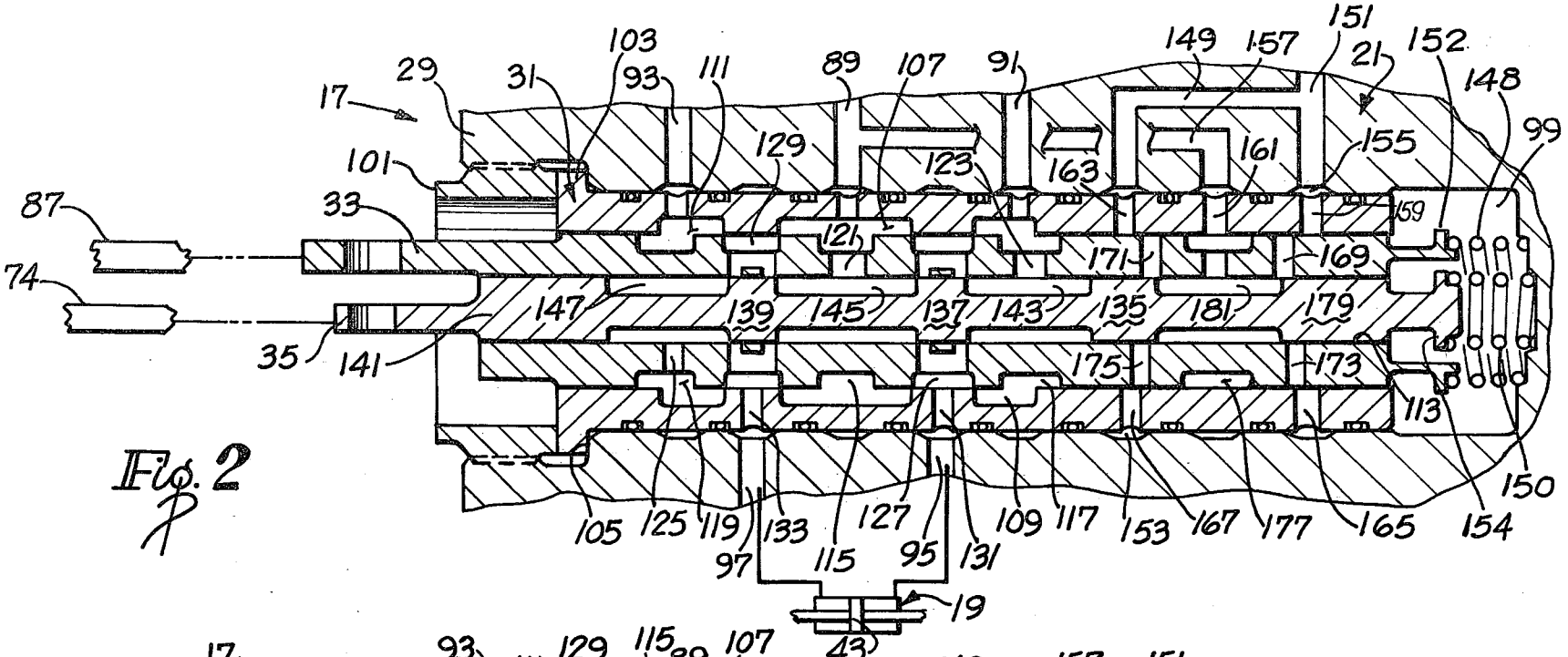
FIG. 2 is a longitudinal sectional view of a servo valve constructed in accordance with the teachings of this invention with both of the slides being at neutral.

As shown in greater detail in FIG. 2, the servo valve 17 includes a housing 29 with a sleeve 31 fixed within the housing. An outer tubular slide 33 is mounted for sliding movement within the sleeve 31, and an inner slide 35 is mounted for coaxial movement within the outer slide.

A pump 37 supplies fluid under pressure to the servo valve 17, and fluid can return from the servo valve to a reservoir 39. As described more fully hereinbelow, the slides 33 and 35 control the flow of fluid between the servo valve 17 and the actuator 19.

The actuator 19 may be of any known construction, and in the embodiment illustrated, it is a balanced actuator which includes a housing 41, a piston 43 slidable within the housing and rods 45 and 47 coupled to the opposite faces of the piston and projecting through the opposite end walls of the housing. The rod 47 is suitably mechanically coupled by a linkage 49 to the flight control surface 13 to enable the actuator 19 to position the flight control surface.

Although the input linkage 15 may take different forms, in the embodiment illustrated, it includes an input lever 51 mounted by a fixed member 53 for pivotal movement about a pivot axis 55. The input lever 51 which may be driven by the pilot of the aircraft has a lever section 57 coupled to the remainder of the input lever 51 by a detent 59. The detent 59, which may be of conventional construction, normally releasably and rigidly attaches the lever section 57 to the remainder of the input lever 51 so that they pivot together about the pivot axis 55 as a single lever. However, if this pivotal movement is resisted by a predetermined force, the detent 59 opens or breaks, and thereafter, the detent 59 serves as a pivot connection between the lever section 57 and the remainder of the input lever 51. Detents of this type are known and have been used, for example, on the rudder controls for the Boeing 707 and the stabilizer controls for the Lockheed L1011.

The input lever 51 drives two linkage sections 58 and 60 for moving the slides 33 and 35, respectively. The linkage section 58 includes a link 61 pivotally joined to the input lever 51 between the pivot axis 55 and the upper or input end of the input lever. The linkage section 58 also includes links 63 and 65 pivotally interconnected as shown, a lever 67 mounted for pivotal movement about a fixed member 69, and a link 71 pivotally joined to the outer end of the lever 67 and to a member 73 of the linkage 49. A link 74 is coupled to a central region of the link 63 intermediate its points of attachment to the links 61 and 65. The link 74 couples the link 63 to the inner slide 35 so that the link 63 can drive the inner slide. In normal operation, the link 63 is positioned by the input lever 51 and by feedback motion from the actuator 19 obtained through the member 73, the link 71, the lever 67 and the link 65.

The second input linkage section 60 includes links 75, 77 and 79, a lever 81 pivotally attached at its mid-point to a fixed member 83, and a link 85 extending between the lower end of the lever 81 and the member 73. The link 77 is suitably mechanically coupled to the outer slide 33 as by a link 87 and/or any other suitable mechanical device. In normal operation, the link 87 can be moved by the input lever 51 through the links 75 and 77 and by feedback from the actuator 19 obtained through the member 73, the link 85, the lever 81 and the links 79 and 77.

The input linkage 15 simultaneously moves the slides 33 and 35 equal amounts in opposite directions. As explained more fully hereinbelow, the jam sensor 21 senses any jam which upsets this phase relationship between the slides 33 and 35 and provides a corrective function. In the embodiment illustrated, the jam sensor 21 in response to a jam ports fluid to the hydraulically operated shutoff valve 25 to close the valve 25 to hydraulically isolate the servo valve 17 from the reservoir 39. In addition, fluid under pressure is ported from the jam sensor 21 to a pressure switch 23 which can be used to carry out a plurality of functions, such as closing an electrical circuit to actuate the indicator 27 to inform the pilot of the jam.

FIG. 2 shows a preferred construction of the servo valve 17. The housing 29 has a supply passage 89 leading to the pump 37, two return passages 91 and 93 leading to the reservoir 39, and two actuator passages 95 and 97 which lead to the actuator 19. The housing 29 has a cylindrical bore 99, and each of the passages 89–97 terminates in an annular groove at the bore 99.

The sleeve 31 is suitably fixedly retained within the bore 99 in any suitable manner, such as by a retainer 101, which is threaded into the outer end of the bore 99 to clamp a flange 103 of the sleeve against a shoulder 105 of the housing 29. The sleeve 31 has an annular groove 107 communicating through a port with the supply passage 89 and grooves 109 and 111 communicating with the return passages 91 and 93, respectively, through appropriate ports in the sleeve.

The outer slide 33 is generally of hollow cylindrical configuration and has a cylindrical axial bore 113 which extends completely through the slide. The slide 33 has annular grooves 115, 117 and 119 on its outer periphery which, in the neutral position, communicate with the grooves 107, 109, and 111, respectively. Ports 121, 123 and 125 extend radially inwardly from the grooves 115, 117 and 119, respectively, to the bore 113. The outer slide 33 also has annular grooves 127 and 129 which communicate through ports 131 and 133, respectively, in the sleeve 31 with the actuator passages 95 and 97. The grooves 127 and 129 have port portions extending radially inwardly to provide communication with the bore 113.

The inner slide 35 is mounted in the bore 113 for axial sliding movement. The inner slide 35 has axially spaced lands 135, 137, 139 and 141 which define annular grooves 143, 145 and 147 therebetween. A pair of springs 148 and 150 act between the inner end of the bore 99 and the slides 33 and 35, respectively, to urge the slides in a direction out of the bore 99. Flanges 152 and 154 on the slides 33 and 35, respectively, positively retain the slides in their respective bores without interfering with stroking of the slides throughout their normal range.

Although the jam sensor 21 could be a physically separate unit, in the embodiment shown in FIG. 2, the jam sensor is formed integrally with the servo valve 17. Thus, the jam sensor 21 includes sensing passages 149 and 151 in the housing 29 with these passages terminating in annular grooves 153 and 155, respectively, which open at the bore 99. In addition, the jam sensor 21 includes a supply passage 157 which receives fluid under pressure from the supply passage 89.

The jam sensor 21 includes radial ports 159, 161 and 163 in the sleeve 31 communicating respectively with the passages 151, 157 and 149. The sleeve 31 also includes ports 165 and 167 communicating respectively with the annular grooves 155 and 153 of the housing 29.

The jam sensor 21 includes ports 169, 171, 173 and 175 in the outer slide 33 and an annular groove 177. The groove 177 has a port for providing communication between the groove and the bore 113. The inner slide 35 has a land 179 spaced axially from the land 135 to define an annular groove 181.

As shown in FIG. 2, the servo valve 17 is in a neutral or null position. In the null position, the lands 137 and 139 block off the ports leading from the annular grooves 127 and 129, respectively, so that there is substantially no flow to or from the actuator 19 through the actuator passages 95 and 97 and the piston 43 of the actuator is held against movement. If the servo valve 17 is moved away from the null position, a fluid flow is established to displace the piston 43 of the actuator 19. Also, in the null position when there is no jam, fluid under pressure cannot flow from the supply passage 157 of the jam sensor 21 to either of the sensing passages 149 or 151.

Figure 3:
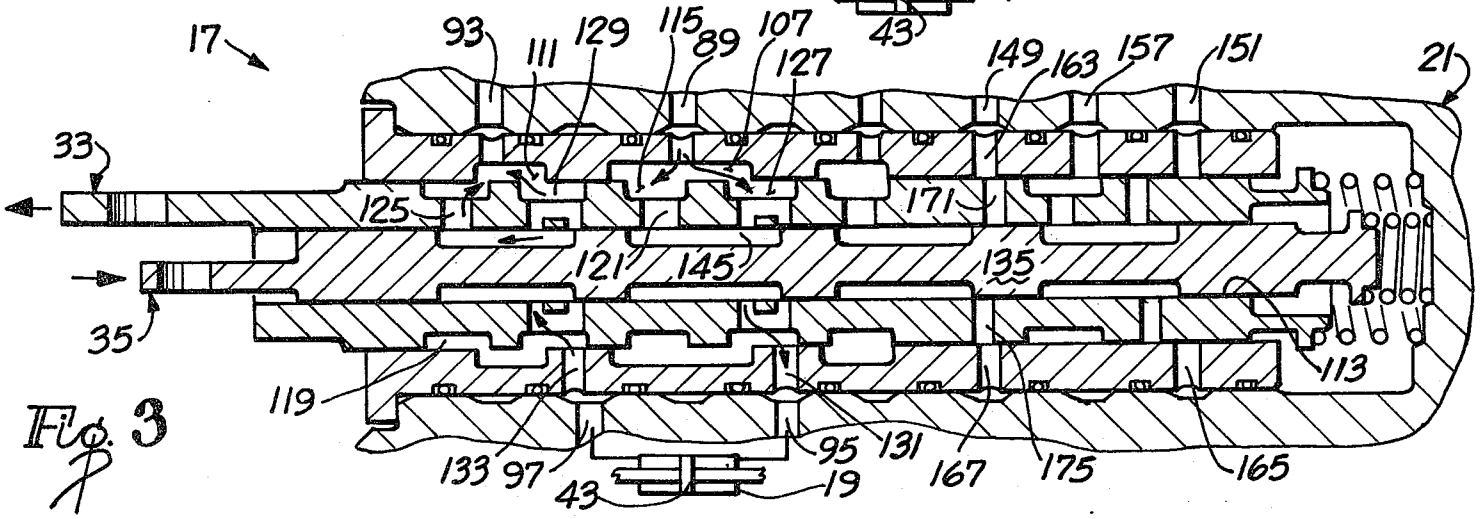
FIGS. 3 and 4 are longitudinal sectional views of the servo valve similar to FIG. 2 illustrating normal operation of the servo valve.

FIG. 3 shows normal operation of the servo valve 17 with the outer slide 33 displaced in a direction out of the bore 99 and the inner slide 35 displaced into the bore 99 to provide fluid under pressure from the supply passage 89 to the right face of the piston 43 of the actuator 19 and to provide communication between the left face of the piston and the return passage 93 to thereby displace the piston to the left as viewed in FIG. 3. More specifically, fluid flows from the supply passage 89 through the groove 107, the groove 115, the port 121, the groove 145, the groove 127, the port 131, and the passage 95 to the actuator 19. The return passage is through the actuator passage 97, the port 133, the grooves 129 and 147, the port 125, the grooves 119 and 111 and the return passage 93 to the reservoir 39.

During normal operation of the valve, the slides 33 and 35 cooperate to prevent fluid under pressure from the supply passage 157 from being supplied to the sensing passages 151 or 149. Specifically, the outer slide 33 closes off the ports 159 and 165, and the land 135 blocks the ports 171 and 175 from the supply passage 157. Accordingly, during normal operation, fluid is not ported to the sensing passages 149 and 151.

To bring about the movement of the slides 33 and 35 to the position shown in FIG. 3, the input lever 51 is pivoted clockwise about the pivot axis 55. This causes the link 74 to drive the inner slide 35 further into the bore 99 and causes the link 87 to withdraw the outer slide 33 a corresponding amount out of the bore 99. As the piston 43 moves to the left as viewed in FIG. 1, the member 73 is pulled to the left to provide feedback motion to the links 74 and 87. As is readily apparent from FIG. 1, movement of the member 73 to the left as viewed in FIG. 1 moves the slides back toward null. Specifically, the feedback motion moves the inner slide 35 out of the bore 99 and the outer slide 33 into the bore 99 until the null position is reached. In this manner, a given input can command a particular position of the piston 43.

Figure 4:
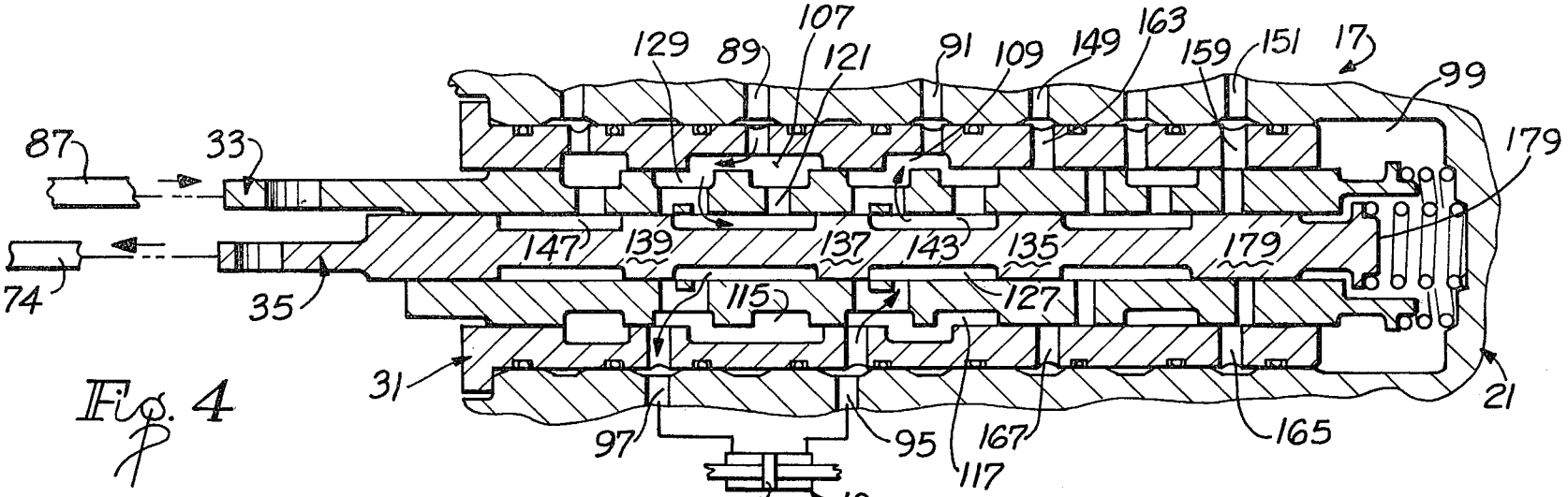

FIG. 4 shows the servo valve 17 operating normally with the slides 33 and 35 stroked in the opposite directions from the directions indicated in FIG. 3. In this position, fluid under pressure is supplied from the supply passage 89 through the actuator passage 97 to the left face of the piston 43 of the actuator 19 as shown by the arrows. Fluid is returned from the right face of the actuator 19 through the servo valve 17 to the return passage 91 as indicated by the arrows in FIG. 4.

With the valve operating normally as shown in FIG. 4, the jam sensor 21 does not provide fluid under pressure to the sensing passages 149 and 151. Specifically, the land 179 blocks the ports 159 and 165 and the outer slide 33 blocks the ports 163 and 167.

Figure 5:
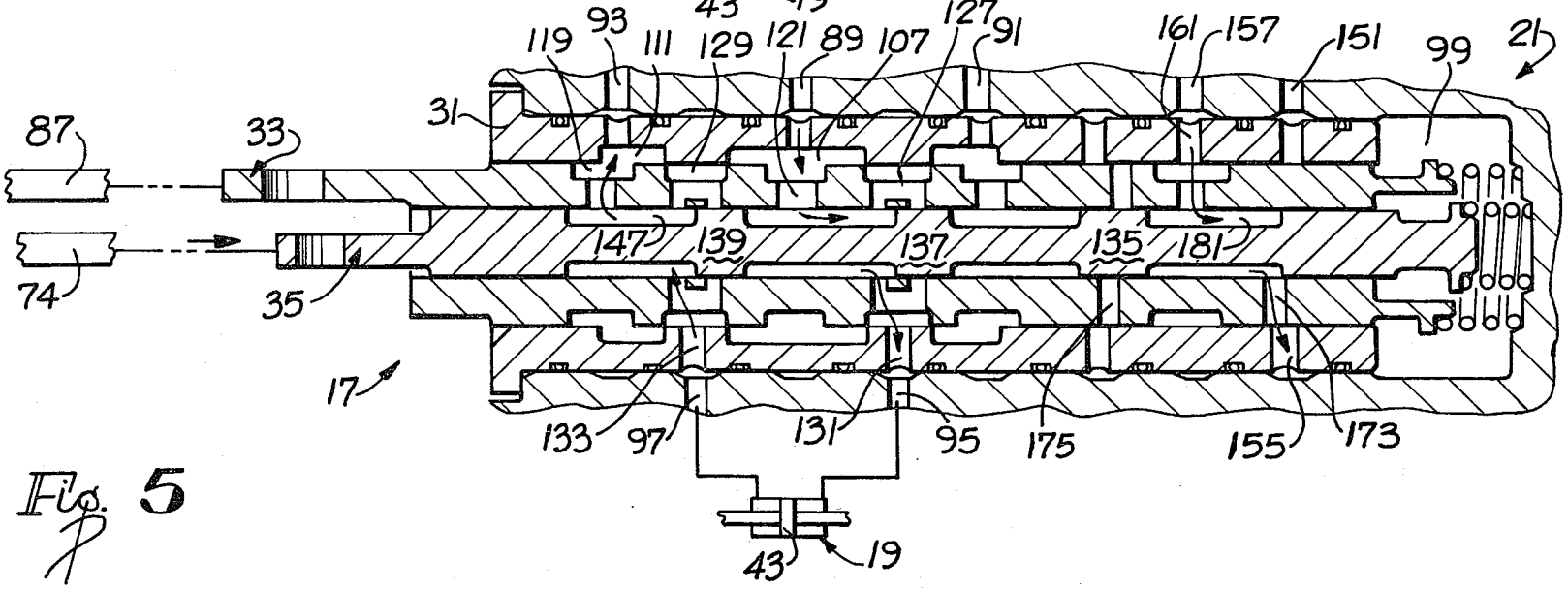
FIG. 5 is a longitudinal sectional view similar to FIG. 2 with the outer slide jammed to the sleeve.

FIG. 5 illustrates operation of the servo valve 17 if the outer slide 33 becomes jammed in the bore of the sleeve 31. For purposes of explanation, the outer slide 33 is shown in FIG. 5 as jammed in its null position, i.e., the same position it occupied in FIG. 2. However, this is purely illustrative as the outer slide 33 could jam to the sleeve 31 in various different positions, but the operation of the servo valve 17 would be substantially as described herein with reference to FIG. 5.

Because the inner slide 35 has surfaces for controlling the flow of fluid, the slide 35 is operable to port fluid to the actuator 19 when the outer slide 33 jams to the sleeve 31. In the embodiment illustrated, each of the slides has one-half control over the actuator 19. Accordingly, with the outer slide 33 jammed, the inner slide 35 has some control over the actuator 19.

In the position shown in FIG. 5, fluid passes from the supply passage 89 through the grooves 107 and 115, the port 121, the grooves 145 and 129, the port 133 and the actuator passage 97 to the actuator 19. Fluid returns from the actuator 19 through the actuator passage 97 to the return passage 93 as indicated by the arrows. If the inner slide 35 is moved out of the bore 99 from the position shown in FIG. 5 so that the lands 137 and 139 are directly radially aligned with the grooves 127 and 129, a null position is established at which the position of the piston 43 in the actuator 19 is fixed. By moving the inner slide 35 farther in the same direction beyond the null position, fluid under pressure is ported from the groove 145 through the groove 129 and the actuator passage 97 to move the piston 43 in the opposite direction. During this time, fluid returns from the actuator passage 95 through the groove 143 to the return passage 91.

It is not essential that the inner slide 35 control the actuator 19 when the outer slide 33 jams to the sleeve 31. Other corrective functions can be provided in addition to, or in lieu of, providing for actuator control by the inner slide 35.

With the outer slide 33 jammed in the sleeve 31 and held stationary with respect thereto, the movement of the slides 33 and 35 in the normal phase relationship, i.e., opposite to each other, is discontinued. The jam sensor 21 responds to this and ports fluid from the supply passage 157 through the groove 181 and the groove 155 to the sensing passage 151 as shown by the arrows in FIG. 5. Once fluid under pressure has been ported to the sensing passage 151, no subsequent movement of the slides 33 and 35 will result in venting or releasing of the fluid pressure signal to the sensing passage 151. This fluid pressure signal may be used in a variety of different ways to provide a corrective function. For example, as shown in FIG. 1, this fluid pressure signal is used to actuate the shut-off valve 25 to hydraulically isolate the servo valve 17 from the pump 37 and the reservoir 39. It is also used to close a pressure switch 23 and to operate the indicator 27.

When the outer slide 33 jams to the sleeve 31 as shown in FIG. 5, the link 87 becomes fixed, and this tends to freeze the entire input linkage 15. However, by applying an increased force to the input lever 51, the detent 59 releases to, in effect, provide a hinged joint (FIG. 1A) between the lever section 57 and the remainder of the input lever 51. This frees the linkage 15 so the input lever 51 can be pivoted and the member 73 moved to stroke the inner slide 35. Thus, the detent 59 prevents the linkage 15 from becoming "frozen" in response to the jam.

Figure 6:
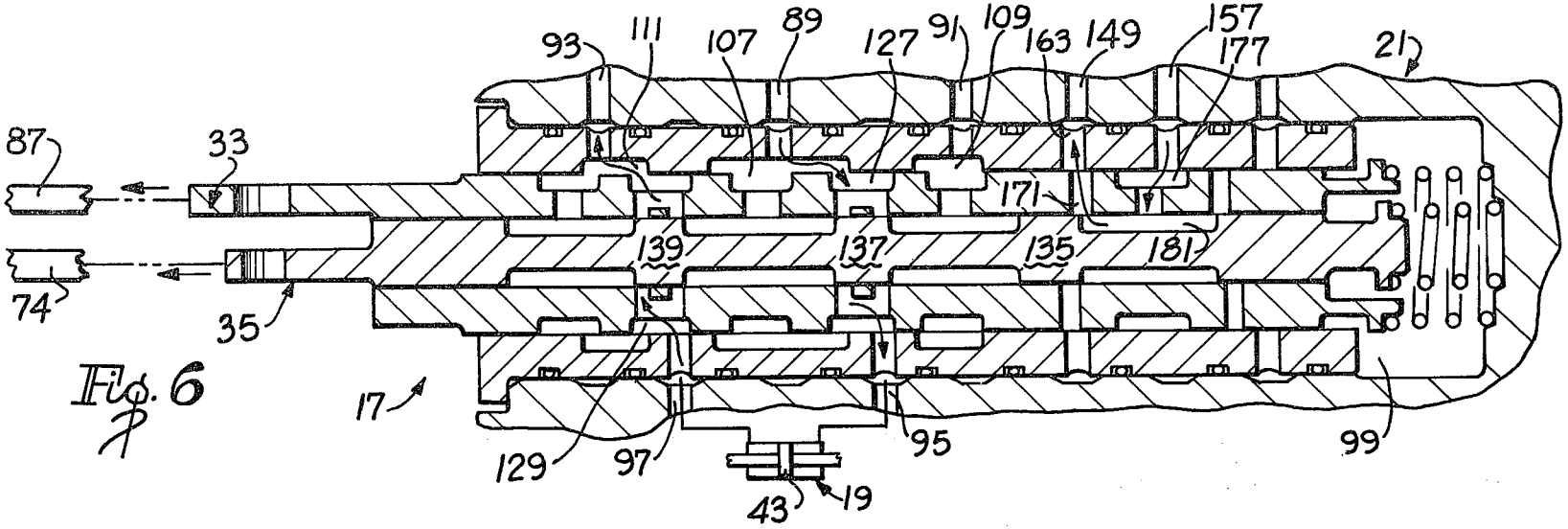
FIG. 6 is a longitudinal sectional view similar to FIG. 2 with the inner slide jammed.

FIG. 6 illustrates operation of the servo valve 17 if the inner slide 35 becomes jammed to the outer slide 33. In FIG. 6, the slide 35 is jammed when the slides 33 and 35 are in the null position relative to each other; however, this is purely illustrative.

With the slide jammed, the slides 33 and 35 can still control or partially control the actuator 19. As shown in FIG. 6, fluid under pressure is supplied from the supply passage 89 through the grooves 107 and 127, the port 131 and the actuator passage 95 to the actuator 19. Similarly, fluid returns from the actuator passage 97 through the grooves 129 and 111 as shown by the arrows in FIG. 6.

With the jammed condition shown in FIG. 6, the slides 33 and 35 can obviously return to the neutral position of FIG. 2 by moving them to the right as viewed in FIG. 6 until the outer slide 33 blocks off the groove 107. By moving the slides 33 and 35 farther into the bore 99, the direction of movement of the actuator can be reversed, and fluid under pressure is supplied from the supply passage 89 through the grooves 107 and 129, the port 133, and the actuator passage 97 to the actuator 19. Fluid returns from the actuator passage 95 through the grooves 127 and 109 to the return passage 91.

With the slides 33 and 35 stuck together, there is no relative movement therebetween. The jam sensor senses this and provides fluid under pressure from the supply passage 157 to the sensing passage 149 through the grooves 177 and 181 and the ports 171 and 163 as shown by the arrows in FIG. 6.

The input linkage 15 in normal operation moves the slides 33 and 35 in opposite directions. Accordingly, if the slide 35 jams to the slide 33, movement of the input lever 51 is resisted. However, by applying a predetermined amount of force to the input lever 51, the detent 59 releases to thereby permit the inner slide 35 to be driven through the links 61, 63 and 74. After the detent 59 releases, the portion of the linkage from the lever section 57 through the links 75, 77, 79 and 85 is freely movable. Accordingly, the outer slide 33 can move with the inner slide 35 and back drive this section of the linkage through the link 87. Similarly, the feedback motion from the link 85 can be accommodated. Accordingly, the detent 59 prevents the linkage 15 from binding when the inner slide 35 becomes jammed in the outer slide 33.

Figure 7:
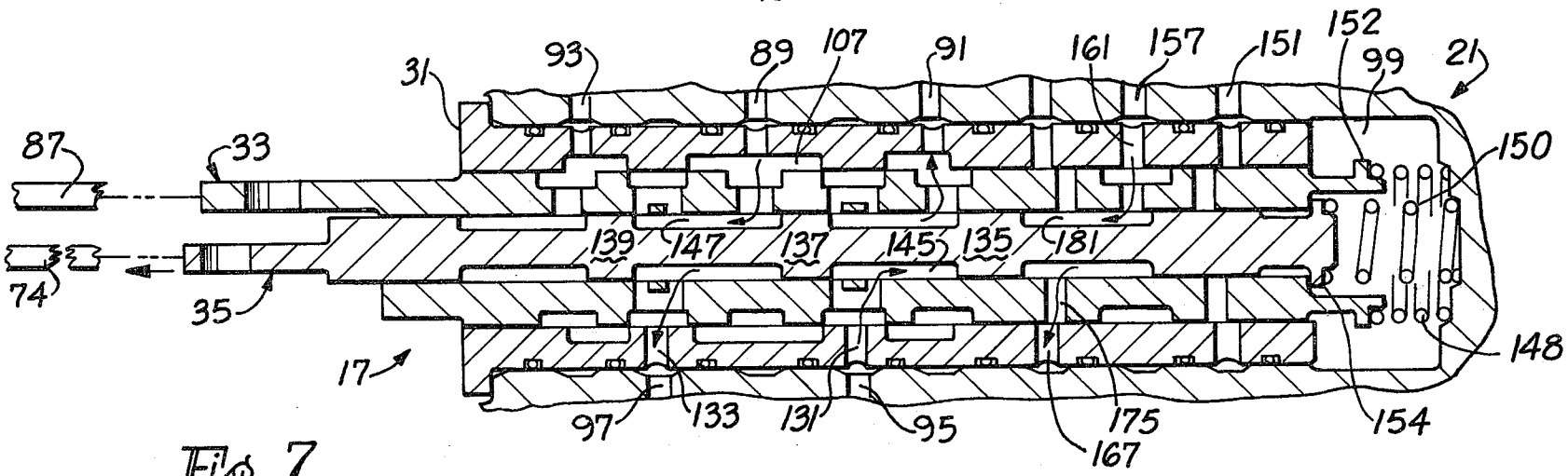
FIG. 7 is a view similar to FIG. 2 showing how the jam sensor detects an open linkage condition in the linkage section which drives the inner slide.

The jam sensor 21 also senses an open linkage condition in the input linkage 15. For example, if the link 74 should break, the input linkage 15 would lose all control over the position of the inner slide 35. In this event, the spring 150 would urge the inner slide 35 in a direction outwardly of the bore 99 to a predetermined position in which the flange 154 on the inner slide engages the inner end of the slide 35. Thereafter, the linkage section 60 would drive the outer slide 33, and the inner slide would move the outer slide. Under these circumstances, the jam sensor 21 would port fluid under pressure to the sensing passage 149 as shown by the arrows in FIG. 7, and the outer slide 33 would maintain one-half authority over the actuator 19.

If the linkage section 60 were to be open, the outer slide 33 would be urged in a direction out of the bore 99 to a predetermined position in which the flange 152 engages the sleeve 31 and the slide 33 would remain in that position. This alters the predetermined phase relationship and the jam sensor would respond thereto and port fluid under pressure to the sensing passage 149.

Although an exemplary embodiment of the invention has been shown and described, many changes, modifications and substitutions may be made by one having ordinary skill in the art without necessarily departing from the spirit and scope of this invention.

I claim:

1. A control system for controlling the flow of fluid under pressure to a controllable device, said control system comprising:

a housing having a supply port for receiving fluid under pressure and a return port for returning the fluid from the housing, said housing having first and second ports for supplying the fluid to the device and for receiving fluid from the device;

first valve means mounted for movement in said housing and including a first slide movable for controlling the flow of fluid from the supply port to said first and second ports and from said first and second ports to said return port;

a second slide mounted for movement in said housing;

input means for moving both of said slides in said housing during normal operation of the control system;

said input means including detent means responsive to the jamming of either of said slides for permitting the input means to drive the other of said slides; and jam responsive means for sensing the jamming of either of said slides and providing a signal in response thereto.

2. A control system as defined in claim 1 including means for providing an indication in response to said signal.

3. A control system as defined in claim 1 including second valve means at least partially on said second slide and drivable by said input means for controlling the flow of fluid from said supply port to said first and second ports and from said first and second ports to said return port whereby said second valve means can at least partially control the device if the first valve means jams.

4. A control system as defined in claim 1 including means responsive to said signal for shutting off the supply of fluid to said device from the housing.

5. A control system as defined in claim 1 wherein said input means moves said second slide in a predetermined phase relationship relative to the first slide during normal operation of the control system, said predetermined phase relationship being altered by the jamming of either of said slides, and said jam responsive means is responsive to the altering of said predetermined phase relationship for providing said signal.

6. A control system as defined in claim 5 including spring means for biasing each of said slides.

7. A control system as defined in claim 1 wherein said jam responsive means includes cooperating surface means driven by said slides and responsive to the jamming of either of said slides for porting fluid under pressure to a predetermined location to provide said signal.

8. A control system as defined in claim 1 wherein said second slide is an inner slide and said first slide is an outer slide, said inner slide being mounted for movement in said outer slide.

9. A control system as defined in claim 8 wherein said input means moves said slides in opposite directions during normal operation of the control system.

10. A control system as defined in claim 9 wherein said jam responsive means includes cooperating surface means driven by at least one of said slides and responsive to the jamming of either of said slides for porting fluid under pressure to a predetermined location to provide said signal.

11. A control system as defined in claim 1 wherein said input means moves said slides relative to the housing and relative to each other during normal operation of the control system.

12. A control system as defined in claim 1 wherein said input means moves said slides in opposite directions during normal operation of the control system.

13. A control system for controlling the flow of fluid under pressure to a controllable device, said control system comprising:

a housing connectable to a source of the fluid under pressure;

first valve means movable in said housing for controlling the flow of fluid under pressure to the device;

a slide mounted for movement in said housing;

input linkage means for moving both of said first valve means and said slide in said housing during normal operation of the control system;

said input linkage means including detent means responsive to the jamming of either of said first valve means or said slide for permitting the input linkage means to drive the other of said first valve means and said slide; and jam responsive means for sensing the jamming of either of said first valve means or said slide and for providing a signal in response thereto.

14. A control system as defined in claim 13 wherein said slide is an inner slide, said first valve means includes an outer slide movable in said housing for controlling the flow of fluid under pressure to the device, said inner slide being movable within said outer slide, said input linkage means includes a first input linkage section for moving said outer slide and a second input linkage section for moving said inner slide, said detent means being in said first input linkage section.

15. A control system as defined in claim 13 wherein said input linkage means includes a first input linkage section for moving the first valve means and a second input linkage section for moving said slide, and said jam responsive means includes first means responsive to either of said input linkage sections being open for providing said signal.

16. A control system as defined in claim 15 wherein said slide is a first slide and said first valve means includes a second slide, said first means includes means for moving at least one of said slides to a predetermined position with respect to the other of the slides in response to the associated linkage section being open.

17. A control system as defined in claim 13 wherein said first valve means includes a second slide movable in said housing for controlling the flow of fluid under pressure to the device and said linkage means includes means for moving said slides in opposite directions from each other during normal operation of the control system.

18. A control system as defined in claim 13 wherein said jam responsive means includes means driven by at least one of said slide and said first valve means responsive to the jamming of either of said slide or said first valve means for porting fluid under pressure to a predetermined location to provide said signal.

19. A control system comprising:

a housing connectable to a source of fluid under pressure;

an actuator;

first slide valve means movable in said housing for controlling the flow of fluid under pressure to and from the actuator;

a second slide mounted for movement in said housing;

input linkage means responsive to an input command and feedback from the actuator for driving both the slide valve means and the slide in said housing during normal operation of the control system;

said input linkage means including detent means responsive to the jamming of either of the first slide valve means or said second slide for permitting the input linkage means to drive the other of said first slide valve means and said second slide; and cooperating surface means movable by said first slide valve means and said second slide and responsive to the jamming of either of said first slide valve means or said second slide for porting fluid in a particular manner to provide a signal.

20. A control system as defined in claim 19 wherein said input linkage means drives said slide valve means and said slide in a predetermined phase relationship during normal operation of the valve, said phase relationship being altered by the jamming of either of said slide valve means or said slide, and said cooperating surface means being responsive to the altering of said predetermined phase relationship for porting fluid to provide said signal.

21. A control system as defined in claim 20 wherein said predetermined phase relationship is in opposite directions.

22. A control system for controlling the flow of fluid under pressure to a controllable device, said control system comprising:

a housing connectible to a source of fluid under pressure;

first valve means for controlling the flow of fluid under pressure to the device;

said first valve means including first and second slides mounted for movement in said housing;

a first input linkage section for moving said first slide during normal operation of the control system;

a second input linkage section for moving said second slide during normal operation of the control system;

said linkage sections moving said slides in opposite directions from each other during normal operation of the control system;

first means responsive to either of said linkage sections being open for providing a corrective function with respect to the control system;

said first means including means for moving at least one of said slides to a predetermined position with respect to the other of the slides in response to the associated linkage section being open, the movement of said one slide to said predetermined position altering the phase relationship of said slides; and said first means being responsive to the altering of the phase relationship to provide said corrective function.

* * * * *